US007593658B2

(12) United States Patent
Nishihara et al.

(10) Patent No.: US 7,593,658 B2
(45) Date of Patent: Sep. 22, 2009

(54) IMAGE FORMING APPARATUS

(75) Inventors: Hiroto Nishihara, Toride (JP); Naoto Watanabe, Kashiwa (JP); Yukio Yokoyama, Sakado (JP); Kuniyasu Kimura, Toride (JP); Takako Hanada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 11/386,804

(22) Filed: Mar. 23, 2006

(65) Prior Publication Data

US 2006/0227205 A1 Oct. 12, 2006

(30) Foreign Application Priority Data

Apr. 8, 2005 (JP) ..... 2005-112160

(51) Int. Cl.
*G03G 15/20* (2006.01)

(52) U.S. Cl. ..... 399/69; 399/70; 399/341; 347/194

(58) Field of Classification Search ..... 399/67–70, 399/341; 347/194
See application file for complete search history.

(56) References Cited

U.S. PATENT DOCUMENTS 5,408,301 A * 4/1995 Tokishige et al. ..... 399/69
6,094,546 A * 7/2000 Nakazato et al. ..... 399/1
6,243,559 B1 * 6/2001 Kurotaka et al. ..... 399/329
6,671,487 B2 * 12/2003 Stringham ..... 399/328
2002/0098022 A1 * 7/2002 Kabashima ..... 399/341
2003/0180063 A1 * 9/2003 Kanesawa et al. ..... 399/69
2004/0042810 A1 * 3/2004 Cho ..... 399/69
2004/0257601 A1 12/2004 Tomiyasu et al. ..... 358/1.9
2005/0206064 A1 9/2005 Moriyama et al. ..... 270/58.08
2005/0271408 A1 * 12/2005 Hayashi ..... 399/70
2007/0059002 A1 3/2007 Yamamoto et al. ..... 399/45

FOREIGN PATENT DOCUMENTS

JP 7-271226 10/1995
JP 2002-372882 12/2002

* cited by examiner

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

An image forming apparatus includes a control unit for controlling a plurality of fixing units independently of one another regardless of a state of an image forming unit, and a receiving unit for receiving image forming requests, and has a control sequence, in which when not all of a recording medium material, a recording medium state, environment, and image data satisfy predetermined conditions, at least one of the plurality of fixing units are caused to operate, and a control sequence, in which when it is detected that an image forming request, for which all of the plurality of fixing units are required, is received by the receiving unit, each currently unused fixing unit is caused to operate. Accordingly, it is possible to realize high productivity even when there exist fixing units not driven due to the recording medium physical properties, recording medium state, environment, image data, or the like.

5 Claims, 7 Drawing Sheets

IMAGE FORMING APPARATUS

BACKGROUND OF THE INVENTION

1. Field of the Invention

The present invention relates to an image forming apparatus employing an electrophotographic system or the like, and more specifically, to an image forming apparatus provided with a plurality of fixing means for heat-fixing unfixed toner on a recording material on a path for transporting the recording material, thereby being capable of passing the recording material through the fixing means on an upstream side with respect to a transport direction of the recording material and then passing the recording material through the fixing means on a downstream side with respect to the transport direction.

2. Related Background Art

Image forming apparatuses, such as printing machines, copying machines, and printers, are becoming to be required to output images having higher image quality. One indicator of image quality of images is glossiness of printed images. In particular, in the case of images such as photographs and illustrations, there is such a tendency that images having higher glossiness are more preferable.

Image glossiness is determined by fixing conditions, such as fixing times, fixing temperatures, fixing widths, and fixing pressures, of fixing apparatuses for fixing unfixed toner images onto sheets such as paper and OHP films. Depending on the fixing conditions at the time of fixation, fused states of the toner and permeability of the toner with respect to the sheets vary, which in turn changes the image glossiness. In ordinary cases, the image glossiness is enhanced as the fixing time is elongated, as the fixing temperature raises, as the fixing width is expanded, and as the fixing pressure increases.

However, it is required not only to enhance the glossiness, but also to reduce warmup time of the fixing apparatus and to reduce power consumption thereof.

As a conventional technique, in order to achieve energy saving, a short warmup time, and high glossiness at the same time, an image forming apparatus including a plurality of fixing devices, that are fixing means, is devised. From a viewpoint of energy saving, in such the image forming apparatus, power application to some of the fixing devices may be suspended. For instance, Japanese Patent Application Laid-Open No. H07-271226 discloses an image forming apparatus including a plurality of image heating devices (fixing devices) and reduces power consumption by driving at least one of the image heating devices at a set temperature and not driving each remaining image heating device at the time of standby. Further, Japanese Patent Application laid-Open No. 2002-372882 discloses a construction in which a plurality of image heating devices are provided, power application to at least one of the plurality of image heating devices is turned off when a glossy mode is set, and power is applied to all of the plurality of image heating devices when a non-glossy mode is set. With the construction described above, image heating devices, whose frequencies of use are low, are rarely supplied of power application.

In the case of an image forming apparatus, into which a plurality of image forming jobs during image forming operation, if the construction includes a plurality of image heating means as described above, there occur the following problems.

In an image forming operation, it is preferable, from a view point of power consumption reduction, that a plurality of image heating means are not used, for example, during image forming job execution, application of power to image heating means not used in this image formation is turned off or an amount of the power applied to the image heating means is reduced. However, when a new image forming job that uses all of the plurality of image heating means is inputted during this image forming job, if power application to place the image heating means not used at the time of the input of the new job under an image heatable state is started to maintain the image heating means under the image heatable state, the longer the currently executed job is performed, the longer the time taken before the new job is started becomes, leading to a loss of energy. Conversely, when the power application for obtaining the image heatable state is started at the time of the start of the new job, a wait time is elongated. Therefore, it is desirable that in such a case, a time, during which the image heatable state is maintained, be shortened as much as possible while shortening the wait time.

SUMMARY OF THE INVENTION

An object of the present invention is to start the new job with a short wait time while reducing power consumption even if a new job that uses all of the image heating means is inputted during an image forming operation in which not all of image heating means are used.

Another object of the present invention is to provide an image forming apparatus including: a first image heating member for heating an image on a recording material;

a second image heating member for heating the image on the recording material heated by the first image heating member;

image forming condition selection means for making a selection from among a first image forming condition, under which the image on the recording material is heated by the first image heating member without being heated by the second image heating member, and a second image forming condition under which the image on the recording material is heated by the first image heating member and then is heated by the second image heating member;

first temperature control means for controlling a temperature of the first image heating member;

second temperature control means for controlling a temperature of the second image heating member to a set temperature during image formation under the second image forming condition and capable of controlling the temperature of the second image heating member to a temperature lower than the set temperature in image formation under the first image forming condition;

decision means for, in a case where an image forming signal corresponding to the second image forming condition is inputted during a job of image formation under the first image forming condition, deciding a timing to start control of a temperature of the second image heating member to said set temperature on the basis of the amount of processes which are necessary until completing the job.

The other objects of the present invention will become apparent from the following description.

DESCRIPTION OF THE PREFERRED EMBODIMENTS

First Embodiment (1) Image Forming Apparatus

Figure 1:
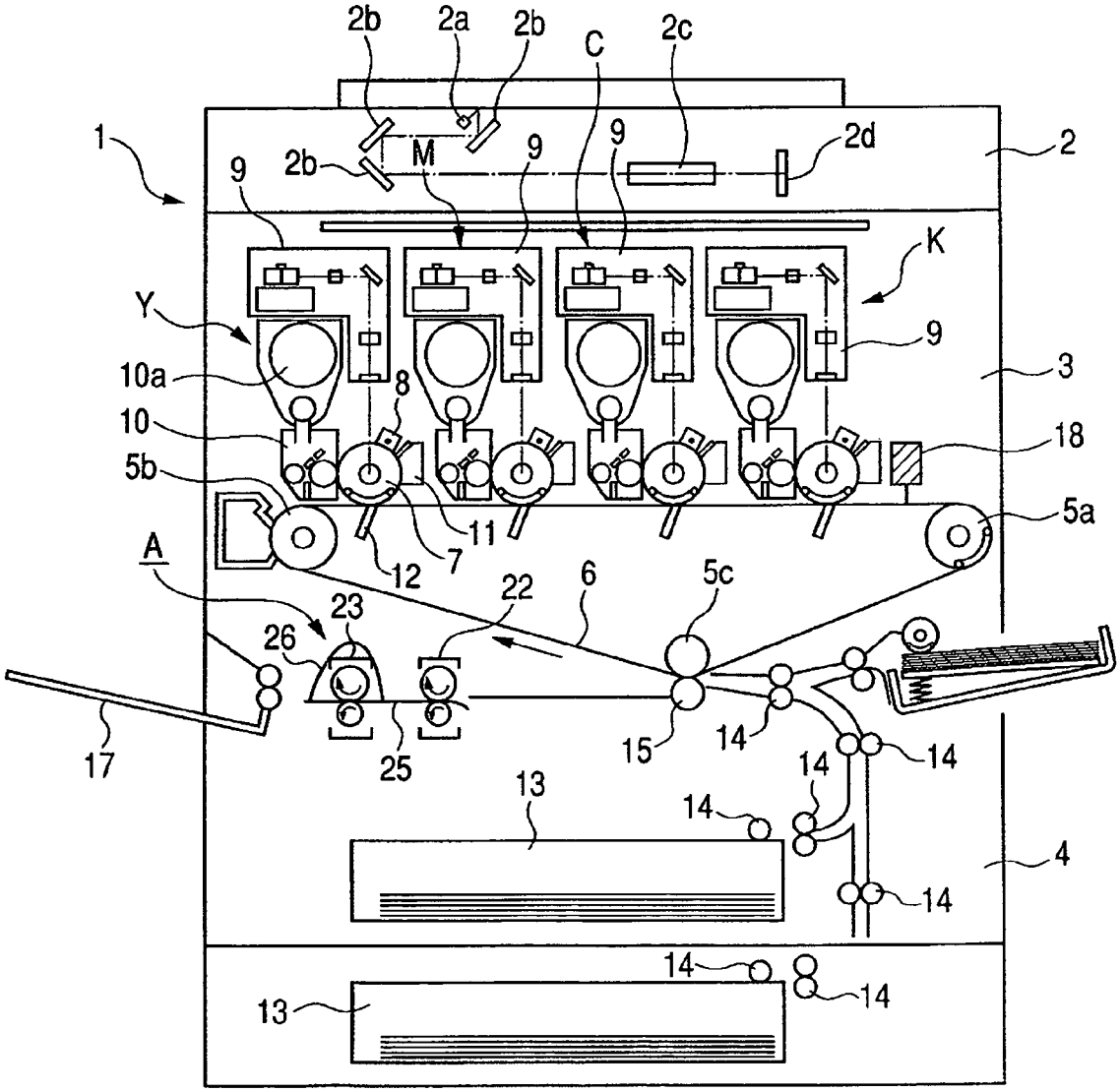
FIG. 1 is a schematic construction diagram of an image forming apparatus in an embodiment of the present invention.

FIG. 1 is a schematic construction diagram of an example of an image forming apparatus according to the present invention.

(Overall Construction of Image Forming Apparatus)

First, an overall construction of the image forming apparatus will be described together with an image forming operation with reference to FIG. 1. Note that FIG. 1 is an overall schematic cross-sectional explanatory diagram of the image forming apparatus according to this embodiment.

In the image forming apparatus in this embodiment, an image reading portion 2 is provided in an upper portion of an apparatus main body 1, an image forming portion 3 is provided below the image reading portion 2, and a recording material transport portion 4 is provided below the image forming portion 3.

The image reading portion 2 applies light from a light source 2*a* to an original placed on an upper surface of the apparatus, reads reflected light from the original with a line sensor 2*d* through mirrors 2*b* and a reading lens 2*c*, converts a result of the reading into a digital signal, and transmits the digital signal to the image forming portion 3.

In the image forming portion 3, four image forming stations Y, M, C, and K are disposed in parallel along a rotation direction of an intermediate transferring belt 6 that is wrapped around a drive roller 5*a*, a driven roller 5*b*, and an inner transfer roller 5*c* and rotates in an arrow direction. The image forming stations form toner images in yellow (Y), magenta (M), cyan (C), and black (K), respectively, in the stated order in the rotation direction of the intermediate transferring belt 6. Note that those four image forming stations are different from one another only in colors of the formed toner images and have the same construction.

Here, the construction of the image forming stations will be described by taking, as an example, the construction of the yellow image forming station Y. A charger 8, a scanning optical apparatus 9, a developing device 10, and a cleaning portion 11 for removing toner remaining on a photosensitive drum 7, which is an image bearing member opposed to the intermediate transferring belt 6, are disposed around the photosensitive drum 7. A toner replenishing device 10*a* for replenishing the developing device with toner is also provided.

With this construction, at the time of image formation, a surface of the photosensitive drum 7 that is rotated is uniformly charged by the charger 8 and light corresponding to image information is applied from the scanning optical apparatus 9 onto the charged photosensitive drum 7, thereby forming an electrostatic latent image. This latent image is visualized through toner development by the developing device 10 and a toner image obtained as a result of the visualization is primarily transferred onto the intermediate transferring belt 6 that is rotated through bias application to a primary transfer member 12.

By separately performing the toner image transfer for images in yellow, magenta, cyan, and black in succession, a color image is transferred to the intermediate transferring belt 6.

In synchronization with the image formation described above, a recording material is transported from the recording material transporting portion 4 to a secondary transfer portion. That is, a recording material is transported from a cassette 13 loaded into a lower portion of the apparatus to the secondary transfer portion by transport rollers 14. Then, a bias is applied to a secondary outer transfer roller 15 at the secondary transfer portion, thereby transferring the toner image on the intermediate transferring belt 6 onto the recording material. The recording material, onto which the toner image has been transferred, is introduced into a fixing apparatus A including two fixing devices (image heating means) that are a first fixing device 22 and a second fixing device 23 and serving as an image heating apparatus having a tandem construction, passes through the first fixing device 22 and the second fixing device 23 in succession, and is subjected to a heat-pressure fixation processing for an unfixed toner image. This fixing apparatus A will be described in detail in the next section (2).

It should be noted here that in FIG. 1, three image position reading detecting portions 18 for detecting position information of the intermediate transferring belt 6 having the same construction are disposed at three locations that are a back side, the center, and a front side in a widthwise direction of the intermediate transferring belt 6.

With this construction, before the image forming apparatus performs image formation, an image of a "+" mark is formed at a predetermined target position on the intermediate transferring belt 6 at each image forming station and the position of the image of the "+" mark (hereinafter referred to as "registration mark") is read by the image position reading detecting portions 18. Then, an image position displacement amount concerning each parameter on the intermediate transferring belt 6 of the image formation position of the image formed at each image forming station is detected and automatic correction is made by correction means.

(2) Fixing Apparatus A

Figure 2:
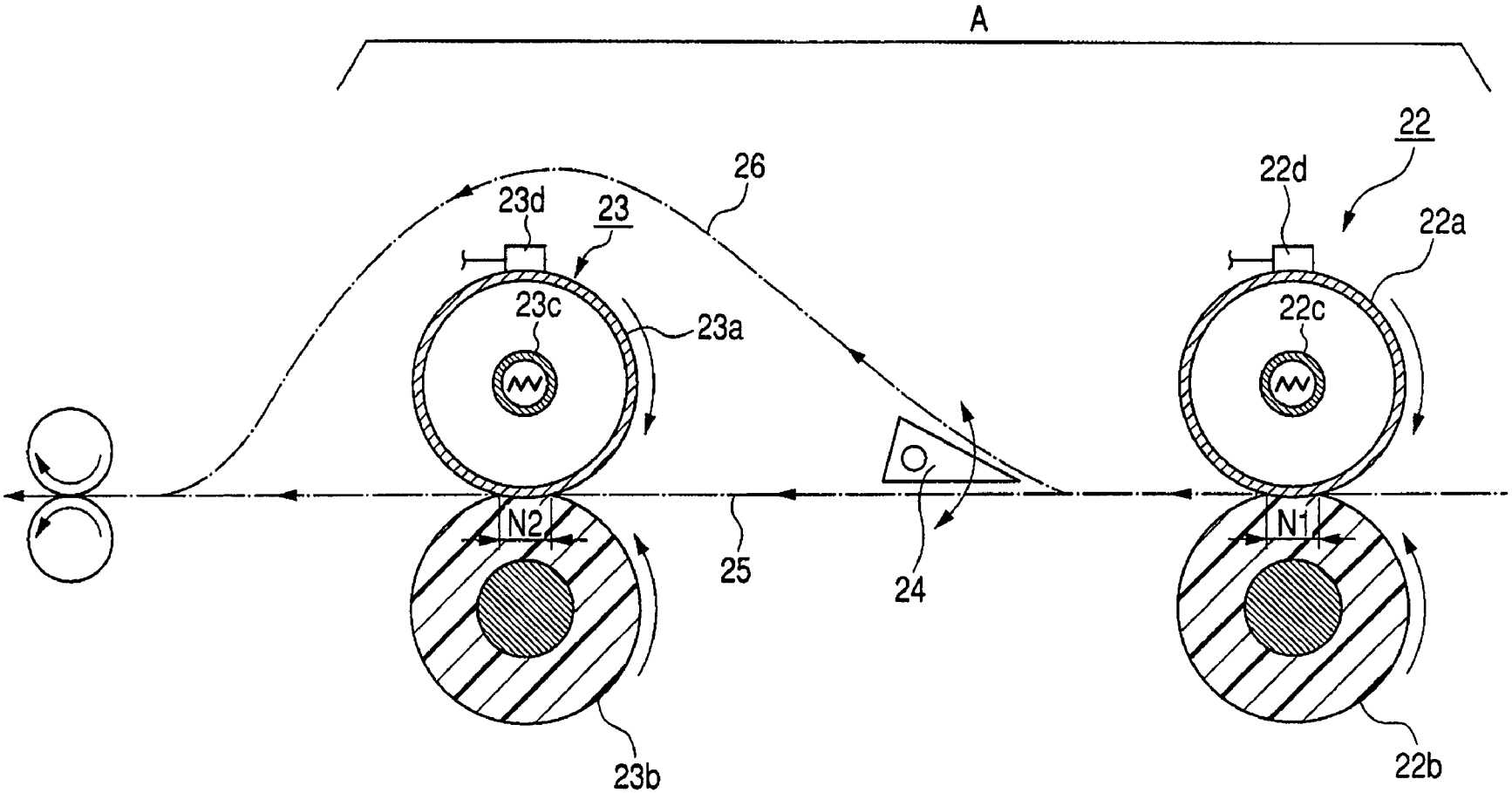
FIG. 2 is an enlarged view of a fixing apparatus portion having a tandem construction.

FIG. 2 is an enlarged view of the fixing apparatus A portion having a tandem construction including two fixing devices that are the first fixing device 22 and the second fixing device 23 arranged in series. The first fixing device 22 and the second fixing device 23 are arranged on an upstream side and a downstream side, respectively, in a recording material transport direction. The first fixing device 22 and the second fixing device 23 of this embodiment are each a fixing device adopting a heat roller system.

1) First Fixing Device 22

In the first fixing device 22, there are provided a fixing roller (fixing upper roller) 22*a* serving as a first image heating member and a pressurizing roller (fixing lower roller) 22*b* serving as a first pressurizing member.

The fixing roller 22*a* is obtained by, for instance, forming an elastic layer made of silicon rubber or the like on a cylindrical core metal made of Al or the like and further forming a release layer, such as a PFA tube, on a surface of the elastic layer. This fixing roller 22*a* includes a fixing heater 22*c* therein, such as a halogen lamp, serving as a heat generator.

The pressurizing roller 22*b* is obtained by, for instance, forming a silicon rubber layer on a core metal and coating a surface of the silicon rubber layer with a release layer such as a PFA tube. The pressurizing roller 22*b* is brought into pressure contact with the fixing roller 22*a* at a predetermined pressing force, thereby forming a fixing nip portion N1 having a predetermined width (size in the recording material transport direction).

The fixing roller 22*a* is rotationally driven by a drive system (not shown) in a clockwise direction indicated with an arrow. The pressurizing roller 22*b* rotates following to the rotation of the fixing roller 22*a*. Further, a thermistor 22*d* serving as a temperature detecting member is provided to contactingly or non-contactingly oppose the fixing roller 22*a*. The fixing roller 22*a* is heated through heat generation by the fixing heater 22*c* to which power is supplied from a power supply portion (not shown). A surface temperature of the fixing roller 22*a* is detected by the thermistor 22*d* and information showing the detected temperature is fed back to a control portion that is first control means. The control portion controls power supply from the power supply portion to the fixing heater 22*c* so that the fixing roller surface temperature shown by the information fed back from the thermistor 22*d* becomes a predetermined fixing temperature (set temperature) which is 200° C., in this embodiment.

2) Second Fixing Device 23

In the second fixing device 23, there are provided a fixing roller 23*a* serving as a second image heating member and a pressurizing roller 23*b* serving as a second pressurizing member.

The fixing roller 23*a* is obtained by, for instance, forming an elastic layer made of silicon rubber or the like on a cylindrical core metal made of Al or the like and further forming a release layer, such as a PFA tube, on a surface of the elastic layer. This fixing roller 23*a* includes a fixing heater 23*c* therein, such as a halogen lamp, serving as a heat generator.

The pressurizing roller 23*b* is obtained by, for instance, forming a silicon rubber layer on a core metal and coating a surface of the silicon rubber layer with a release layer such as a PFA tube. The pressurizing roller 23*b* is brought into pressure contact with the fixing roller 23*a* at a predetermined pressing force, thereby forming a fixing nip portion N2 having a predetermined width.

The fixing roller 23*a* is rotationally driven by a drive system (not shown) in a clockwise direction indicated with an arrow. The pressurizing roller 23*b* rotates following to the rotation of the fixing roller 23*a*. Further, a thermistor 23*d* serving as temperature detecting means is provided to contactingly or non-contactingly oppose the fixing roller 23*a*. The fixing roller 23*a* is heated through heat generation by the fixing heater 22*c* to which power is supplied from a power supply portion (not shown). A surface temperature of the fixing roller 23*a* is detected by the thermistor 23*d* and information showing the detected temperature is fed back to a control portion that is second control means. The control portion controls power supply from the power supply portion to the fixing heater 23*c* so that the fixing roller surface temperature shown by the information fed back from the thermistor 23*d* becomes a predetermined fixing temperature which is 190° C., in this embodiment.

It is preferable that the set temperature of the first image heating member be higher than the set temperature of the second image heating member because the first image heating member is required to fix an unfixed toner image on a recording material.

A fixing flapper 24 is provided between the first fixing device 22 and the second fixing device 23 and serves as selection means for switching a recording material course switching. The control portion performs control in accordance with the properties (image data/materials/settings) of jobs so that the fixing flapper 24 is driven to a first switching position, at which the recording material P which has passed through the first fixing device 22 is guided to a recording material transport path 25 in which the recording material P is introduced into the second fixing device 23, and a second switching position at which the recording material P which has passed through the first fixing device 22 is guided to a recording material transport path 26 in which the recording material P detours around the second fixing device 23.

The image forming apparatus according to the present invention has a first image forming condition, under which heating by the first fixing device is performed while heating by the second fixing device is not performed, and a second image forming condition under which both of the heating by the first fixing device and the heating by the second fixing device are performed.

For instance, in the case of a job using glossy paper as the recording material or in the case of a glossy image mode (second image forming condition) that requires image glossy, the control portion switches the fixing flapper 24 to the first switching position, thereby introducing the recording material P which has passed through the first fixing device 22 into the second fixing device 23 through the recording material transport path 25 and subjecting the recording material P to a total of two fixation processings by the first fixing device 22 and by the second fixing device 23. The recording material introduced into the second fixing device 23 has already passed through the first fixing device 23 and is placed under a toner fixed state, so by further passing the recording material through the second fixing device 23, it becomes possible to securely realize stabilized fixability and desired glossiness regardless of the material of the recording material and image data.

On the other hand, in the case of a non-glossy image mode (first image forming condition) in which glossy is not required, the control portion switches the fixing flapper 24 to the second switching position, thereby guiding the recording material P which has passed through the first fixing device 22 to the recording material transport path 26, in which the recording material P detours around the second fixing device 23, and subjecting the recording material P only once to the fixation processing by the first fixing device 22. It is possible to make a selection from among the glossy mode and the non-glossy mode through input using an operating portion of the image forming apparatus or the like.

In this embodiment, switching between the first image forming condition and the second image forming condition is performed based on glossy but the present invention is not limited to this and the switching may be performed with reference to a thickness of the recording material. For instance, fixation is performed under the first image forming condition in the case of plain paper and is performed under the second image forming condition in the case of a thick sheet that requires a large quantity of heat.

(3) Control System for Image Forming Apparatus

Figure 3:
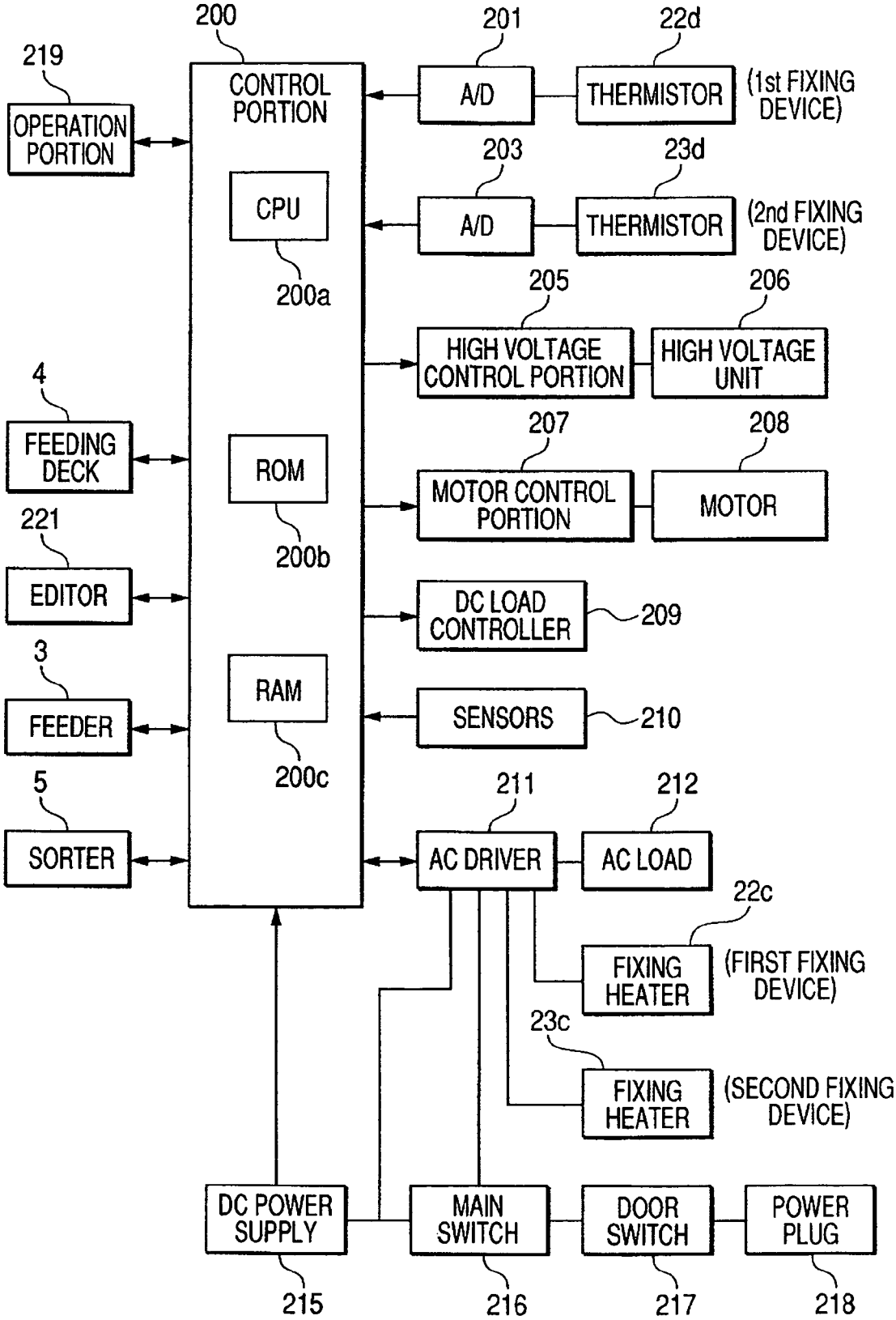
FIG. 3 is a block diagram showing a control system for the image forming apparatus.

1) FIG. 3 is a block diagram showing an example of an overall control system for the image forming apparatus. In the figure, a control portion (controller) 200 is composed of a CPU 200*a*, a ROM 200*b*, a RAM 200*c*, and the like and centralizedly controls a copy sequence based on a program stored in the ROM 200*b*.

On the operating portion 219, a key input portion including a copy mode setting key, a copy number setting key, a copy operation start key, a copy operation stop key, a fixation power saving key (hereinafter referred to as "power saving key") that is adjusting means for adjusting an amount of electric power supply to the second fixing device 23, a reset key that returns an operation mode to a standard state, a glossiness setting key used to designate glossiness of output images, and the like and a display portion, such as an LED display or a liquid crystal display, for displaying an operation mode setting state and the like are disposed.

When the power saving key on the operating portion 219 is pressed down, supply of electric power to the second fixing device 23 is stopped. Alternatively, a method may be used with which when the power saving key is depressed, the second fixing device 23 is set at a temperature that is lower than a set fixing temperature at the time of image heating. To be more specific, for instance, the second fixing device 23 is set at 200° C. at the time of image heating and is set at 100° C. when the power saving key is operated. In this case, a plurality of temperatures may be set for the case where the power saving key is operated.

A first temperature control means will be described hereinafter. In the embodiment, the first temperature control means consists of CPU 200*a*. The thermistor 22*d* detects the surface temperature of the fixing roller 22*a* of the first fixing device 22. A value obtained through A/D-conversion of the detected surface temperature by an A/D converter 201 is inputted into the controller 200. The controller 200 controls power application to the heater according to the detection value of the thermistor 22*d* so that the surface temperature of the fixing roller 22*a* of the first fixing device 22 assumes a predetermined value (set fixing temperature).

A second temperature control means will be described hereinafter. In the embodiment, the first temperature control means consists of CPU 200*a*. The thermistor 23*d* similarly detects the surface temperature of the fixing roller 23*a* of the second fixing device 23. A value obtained through A/D-conversion of the detected surface temperature by an A/D converter 203 is inputted into the controller 200. The controller 200 controls power application to the heater according to the detection value of the thermistor 23*d* so that the surface temperature of the fixing roller 23*a* of the second fixing device 23 assumes a predetermined value (set fixing temperature).

A high voltage portion 205 performs control of a high voltage unit 206 that applies predetermined potentials to various sites in the main body image output portion 1 such as a charging system composed of a primary charger, a transfer charger, and the like, and a developing apparatus.

A motor control portion 207 controls drive of various motors 208 such as a stepping motor.

A DC load control portion 209 controls drive of a solenoid of the fixing flapper 24, a solenoid of a post-fixation flapper 28, the photosensitive drum 17, the fixing rollers 22*a* and 23*a* of the first and second fixing devices 22 and 23, respectively, a fan, and the like.

Sensors 210 for detecting jamming of the recording material and the like, send signals to be inputted into the control portion 200.

An AC driver 211 controls AC power supply to an AC load 212, such as a light source 7, and fixing heaters 22*c* and 23*c* of the first and second fixing devices 22 and 23, respectively. Also, the AC driver 211 detects abnormalities of the light source 7, the fixing heaters 22*c* and 23*c*, and the like and sets a main switch 216 having a shutoff function under an off state when detecting any abnormality.

A DC power supply 215 supplies DC power to the controller 200 and the like. Here, AC power inputted from a power plug 218 is inputted into the DC power supply 215 through a door switch 217 and the main switch 216.

A feeding deck 4 is a feeding apparatus for increasing the number of recording materials that can be stacked and is connected as an option.

An editor 221 for inputting position information for trimming, masking processing, and the like is connected as an option.

A feeder 3 for automatically setting a plurality of originals is connected as an option.

A sorter 5 for sorting discharged recording materials is connected as an option.

In this embodiment, first control means for controlling a temperature of the first image heating member and second control means for controlling a temperature of the second image heating member are included in the same control portion. However, as a matter of course, the present invention is not limited to this construction and a construction, in which a plurality of control portions are provided, is also applicable.

Figure 4:
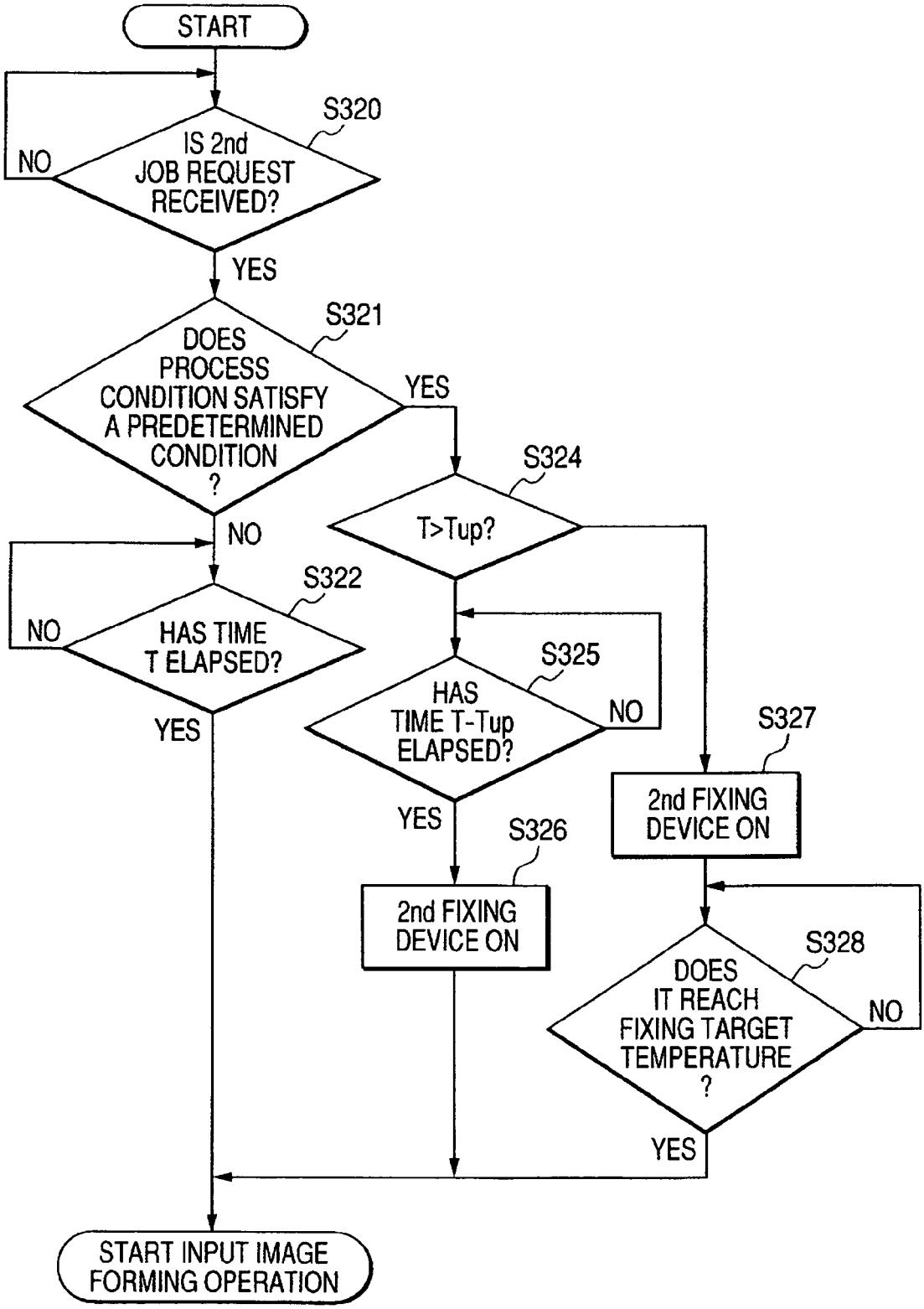
FIG. 4 is a flowchart of control of the fixing apparatus during image formation.

2) Next, control of the first and second fixing devices 22 and 23 when a first image forming job request is accepted and an image forming operation is started will be described with reference to FIGS. 4 to 6. Here, it is assumed that the power saving key on the operating portion 219 is already pressed down and electric power supply to the second fixing device 23 is stopped (turned OFF).

Figure 5:
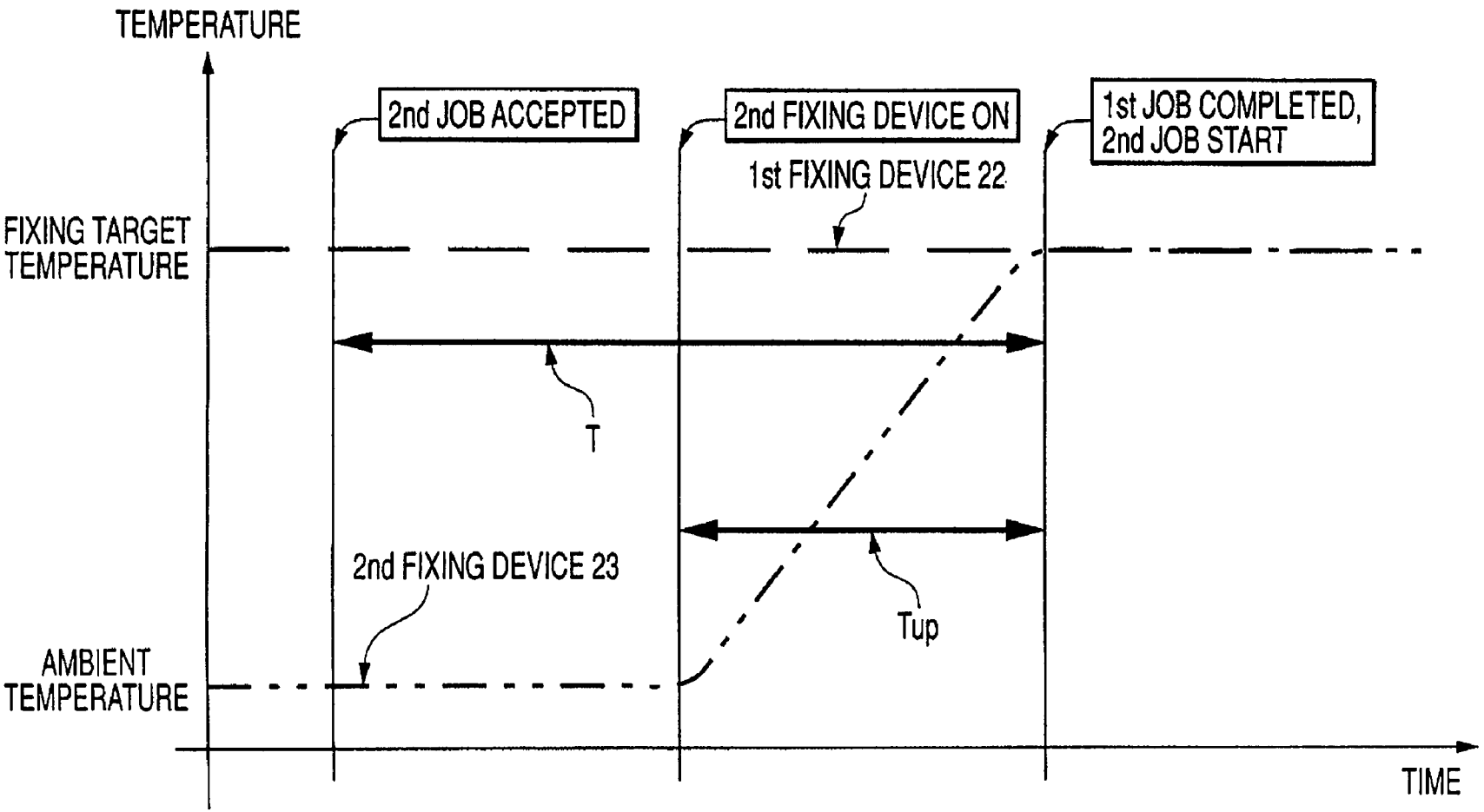
FIG. 5 is a diagram (first diagram) showing the control of the fixing apparatus during image formation in a time-series manner.
Figure 6:
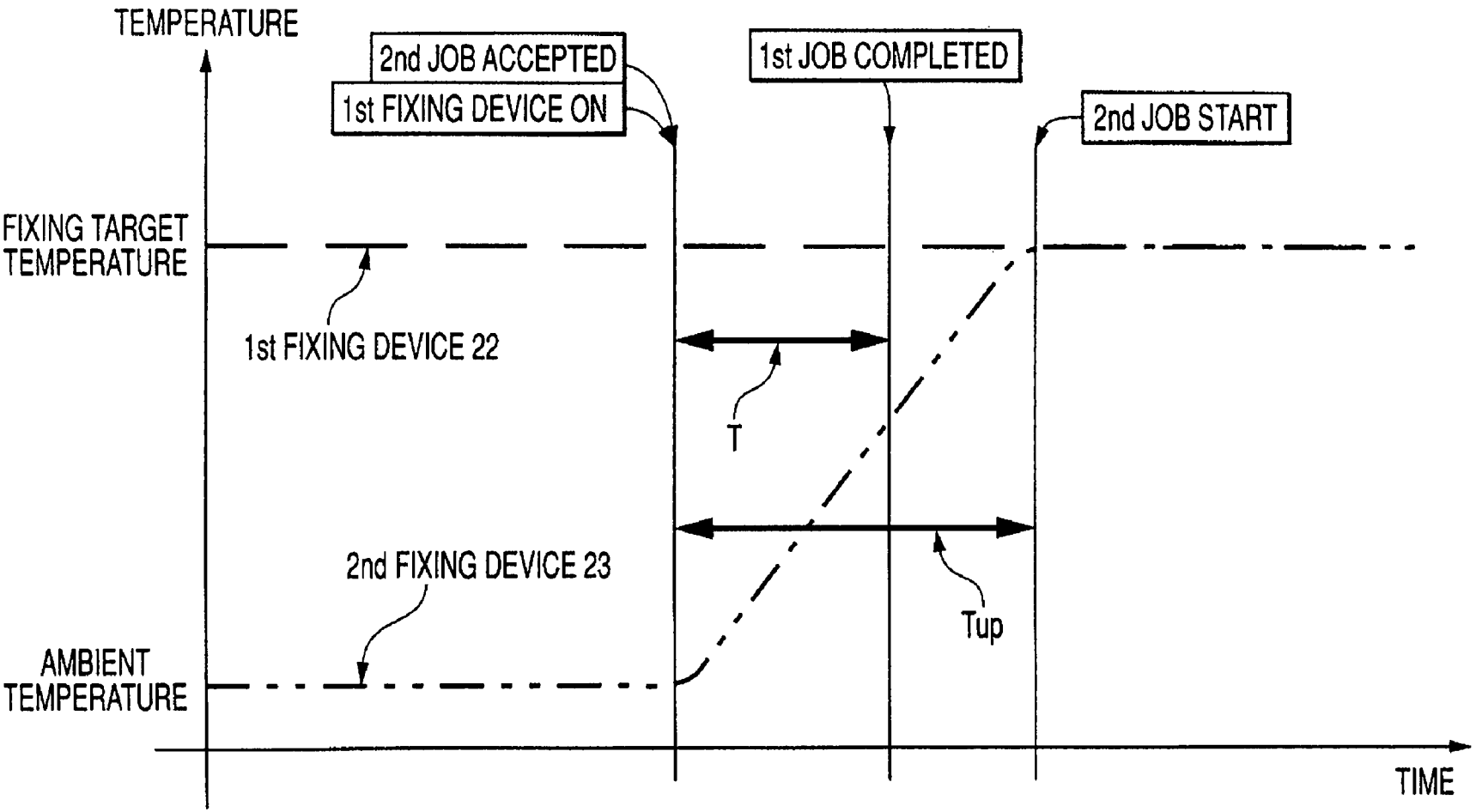
FIG. 6 is another diagram (second diagram) showing the control of the fixing apparatus during image formation in a time-series manner.

FIGS. 5 and 6 are each a drawing in which control of the first and second fixing devices 22 and 23 in the case where the first image forming job is already started is shown in a time series manner. FIG. 4 is a flowchart showing the control in that case.

In FIGS. 5 and 6, the vertical axis represents a fixing temperature and the horizontal axis represents time. In order to perform image formation in response to the first image forming job request, the temperature of the fixing roller 22*a* of the first fixing device 22 is set at a fixing target temperature during image formation. In this embodiment, the fixing target temperature is 200° C. Under circumstances in which no electric power is supplied to the heat source 23*c* of the fixing roller 23*a* of the second fixing device 23 and the fixing roller 23*a* assumes approximately the same temperature as an ambient temperature (which varies depending on a use state of the second fixing device 23), a second image forming job is inputted through pressing down of the copy operation start key on the operating portion 219 or input of a print signal by a user. As a result, the control portion 200 judges that a second image forming job request is received (step S320 of FIG. 4). When the control portion 200 judges that no second image forming job request is received, polling is performed to wait until it is judged that a second image forming job request is received (step S320).

When it is judged that a second image forming job request is received, it is next judged whether process conditions satisfy at least one of predetermined conditions (step S321). As will be described later, in this step, it is judged under which one of the first image forming condition and the second image forming condition the second image forming job request should be processed.

When the control portion 200 judges in step S321 that the process conditions satisfy none of the predetermined conditions and the second image forming job request should be processed under the first image forming condition, it is waited until a time T that is a time interval between a second image forming job request reception timing and first image forming job completion has elapsed (step S322).

Next, it will be described hereinafter about decision means for deciding a timing to start control of a temperature of the second image heating member to said set temperature on the basis of a process which is necessary until completing the job. In the embodiment, the decision means consists of a CPU 200*a*.

When the control portion 200 judges in step S321 that the process conditions satisfy at least one of the predetermined conditions and the second image forming job request should be processed under the second image forming condition, comparison of the time T and a time Tup with each other is performed (step S324). Here, as shown in FIGS. 5 and 6, the time T is an assumed time interval between the second image forming job request reception timing and the first image forming job completion and the time Tup is a time calculated by calculating means, such as a CPU, that is, a time taken by the fixing roller 23*a* to rise from a temperature at the time of the second image forming job request reception to the fixing target temperature after electric power supply to the heat source 23*c* of the second fixing device 23 is started. In this embodiment, the time T is calculated from an amount of remaining image formation and an amount of processing executable per unit time. Also, the time Tup is calculated from a temperature of the second heating member at the time of the input, the fixing target temperature, and input electric power. The time T and the time Tup are each an assumed time, so there occurs no problem even when they deviate from an actual time to some extent. In the embodiment, the amount of processes which are necessary until completing the job is the amount of remaining image formation processes at the time of the second image forming signal being inputted. Moreover, the amount of processes which are necessary until completing the job may be a count value, which is determined in advance by counting time until completing the first image forming job.

When it is judged in step S324 that the time T is longer than the time Tup, that is, when, as shown in FIG. 5, the time taken by the fixing roller 23*a* of the second fixing device 23 to reach the fixing target temperature is shorter than the time interval between the image signal input and the first image forming job completion, it is waited until a time T-Tup has elapsed (step S325). When the time T-Tup has elapsed, electric power supply to the heat source 23*c* of the second fixing device 23, that is, transition of the second fixing device 23 to an image heatable state is started (step S326).

As a result of the operation described above, at a timing at which the first image forming job is completed, the fixing roller 23*a* of the second fixing device 23 reaches the fixing target temperature, so it becomes possible to uninterruptedly start the second image forming job, which prevents lowering of productivity.

On the other hand, when it is judged that the time T is shorter than the time Tup (step S324), that is, when, as shown in FIG. 6, the first image forming job is completed before the fixing roller 23*a* of the second fixing device 23 reaches the fixing target temperature, the electric power supply to the heat source 23*c* of the second fixing device 23 is started instantly (step S327). That is, approximately concurrently with the input, control of the temperature of the second fixing device for image formation is started. When it is judged that the fixing roller 23*a* of the second fixing device 23 reaches the fixing target temperature (step S328), an image forming operation is started. It is impossible to realize desired fixability and glossiness before the fixing roller 23*a* of the second fixing device 23 reaches the fixing target temperature, so even after the first image forming job is completed, the second image forming job is prohibited for a time Tup-T.

Figure 7:
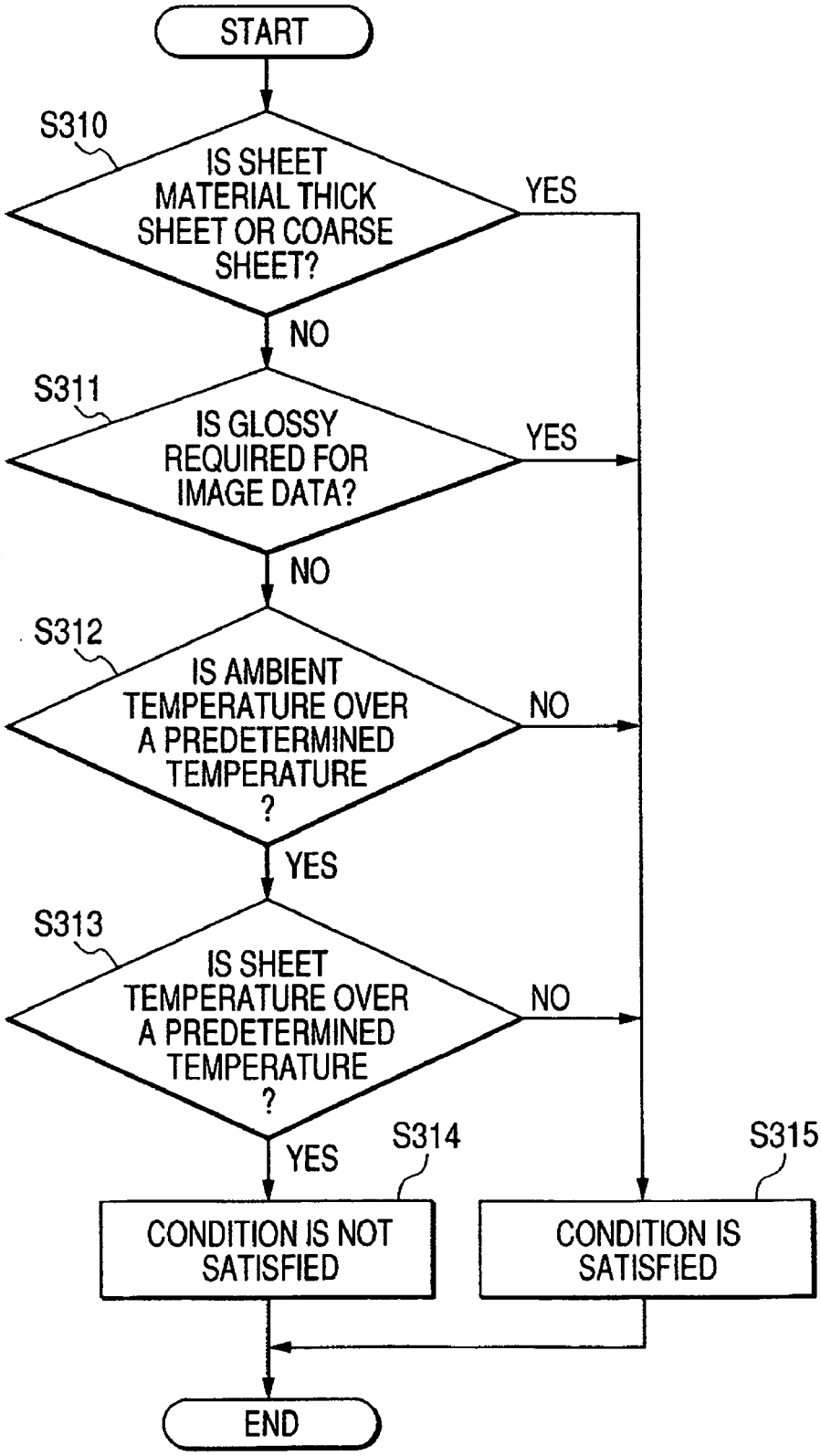
FIG. 7 is a flowchart showing a comparison of process conditions.

Next, a flow of the comparison of the process conditions and the predetermined conditions with each other in step S321 to judge whether the electric power supply to the heat source 23*c* of the second fixing device 23 should be started will be described with reference to FIG. 7. Through this flow, it is judged whether the inputted job is a job corresponding to the first image forming condition or a job corresponding to the second image forming condition.

First, when, in step S310, it is judged that the recording material passed for use is a thick sheet or a coarse sheet, it is judged that the second image forming condition is satisfied (step S315). Then, the comparison flow is ended as it is. The kind of the sheet material may be detected with reference to a setting made by a user from the operating portion 219 or may be automatically detected by a sensor, such as a CCD sensor or a photo interrupter, at a feeding cassette. When the recording material is a thick sheet or a coarse sheet, there is a possibility that the sheet will absorb heat from the fixing roller 22*a* at the time of passage through the first fixing device 22 and therefore it becomes impossible to achieve high fixability. Therefore, when the recording material is a thick sheet or a coarse sheet, it is required to pass the recording material through the second fixing device 23 in order to secure fixability.

Next, when, in step S311, the control portion 200 judges that glossy is required for image data, it is judged that the second image forming condition is satisfied (step S315). Then, the comparison flow is ended as it is.

For instance, image data accumulated in an image memory is subjected to image area separation or the like to detect a ratio between image data and character data and when an image data ratio is high, it is judged that glossy is required. Alternatively, the operating portion 219 may include a selection portion for allowing a user to make an output image glossiness selection from among, for instance, output of high gloss images and output of low gloss images and the judgment as to whether glossy is required may be made with reference to a setting made by the user from this selection portion. In ordinary cases, satisfactory fixability is achieved by merely passing the recording medium bearing an unfixed toner image through the first fixing device 22 provided on an upstream side of the transport path but it is possible to realize high glossiness by further passing the recording medium through the second fixing device 23 provided on a downstream side. Therefore, it is required to judge whether high glossiness is required for image data.

Next, when, in step S312, the control portion 200 judges that an ambient temperature is not over a predetermined temperature, it is judged that the condition is satisfied (step S315). Then, the comparison flow is ended as it is. The higher the ambient temperature is, the more favorable fixability of an image with respect to a sheet becomes, so it becomes unnecessary to pass the sheet through the second fixing device 23. Here, it is possible to arbitrarily set the predetermined temperature. Therefore, it is required to judge whether the ambient temperature is over the predetermined temperature.

Next, when, in step S313, it is judged that the sheet temperature is not over a predetermined temperature, it is judged that the second image forming condition is satisfied (step S315). Then, the comparison flow is ended as it is. It is possible to detect the sheet temperature by measuring a temperature of a sheet fed from a feeding portion with a temperature sensor. The higher the sheet temperature is, the more fixability of an image with respect to the sheet becomes favorable, so it becomes unnecessary to pass the sheet through the second fixing device 23. Here, it is possible to arbitrarily set the predetermined temperature. Therefore, it is required to judge whether the sheet temperature is over the predetermined temperature. Further, in this embodiment, the sheet temperature is detected but when image formation is possible on both sides of the recording material, whether a double-sided image forming operation is performed may be judged. This is because, when a double-sided operation is performed, since the sheet has already passed through the first fixing device 22 for image fixation onto a surface, the sheet is heated to a high temperature. Therefore, when such a double-sided image forming operation is not performed, it is judged that the condition is satisfied (step S315). Then, the comparison flow is ended as it is.

When, as a result of the process condition comparison described above, it is judged that the second image forming condition is not satisfied (step S314). Then, the comparison flow is ended as it is.

In this embodiment, a construction has been described in which when the power saving key is pressed down, the power application to the second fixing device is not performed at least during execution of the first image forming job. Further, it is possible to obtain the same effect with a construction in which a plurality of energy saving modes having different standby set temperatures, even if the waiting is performed at one of the standby set temperatures lower than the set temperature at the time of image heating of the second fixing device.

Also, in this embodiment, a construction has been described in which the power application to the second fixing device is not performed when the second fixing device is not used. However, a construction is also possible which has a power saving key with which it is possible to select whether at least during execution of an image forming job that does not use the second fixing device, unless an image signal corresponding to the second fixing device is inputted, the second fixing device is turned off or is placed under a low set temperature waiting state.

Further, there occurs no problem even in the case of a construction in which the first fixing device and the second fixing device have a plurality of set temperatures during image heating. In this case, for instance, depending on a level of glossiness inputted into the image forming apparatus, the set temperature during image heating of the second fixing device is changed. To be more specific, for instance, the second fixing device is set at 200° C. in the case of a high glossiness mode and is set at 180° C. in the case of a middle glossiness mode. Here, the number of set temperatures, to which the second fixing device is switchable, may be increased.

Still further, there occurs no problem even in the case of a construction in which the set temperature during image heating of the first fixing device is changed depending on the kind of the recording material. When glossiness control is performed, it is preferable that the fixation state of the toner image on the recording material after the recording material has passed through the first fixing device be maintained constant regardless of the kind of the recording material because it becomes possible to enhance the accuracy of the glossiness control by the second fixing device. In particular, for instance, the first fixing device is set at 200° C. in the case of plain paper, is set at 210° C. in the case of a thick sheet, and is set at 190° C. in the case of a thin sheet. As a matter of course, the number of set temperatures may be increased from three in this example.

Further, in this embodiment, a construction using fixing rollers has been described but it is possible to obtain the same effect even with a construction using fixing belts or the like. Further, each fixing roller is heated by a heater but the present invention is not limited to this and it is possible to provide the same effect even when the fixing roller is heated with an induction heating system using a coil.

As described above, when electric power supply is performed for only one of the plurality of fixing devices during first image formation, in a case where a second image forming request, for which all of the plurality of fixing devices need to be used, is received, all of the plurality of fixing devices reach the fixing target temperature immediately before the first image forming operation is completed, thereby avoiding a waste of electric power, so it is possible to maintain high productivity because the second image forming operation is started immediately after the completion of the first image forming operation.

Further, even if the first image forming operation is completed before all of the plurality of fixing devices reach the fixing target temperature, the second image forming operation is prohibited until all of the plurality of fixing devices reach the fixing target temperature, so it is possible to prevent fixation failure due to fixation at a low temperature.

It should be noted here that the plurality of fixing devices (fixing means) of the fixing apparatus having the tandem construction are not limited to the fixing devices adopting the heat roller system of the embodiment of the present invention. Further, the number of the fixing devices is not limited to two and may be increased to three or more.

As described above, according to the present invention, when a new job in which all of the image heating members are used inputted during image formation in which some of image heating members are not used, it is possible to elongate a standby state of each second image heating member, in which the second image heating member is set at a low temperature, without causing a delay of start of the new job.

Second Embodiment

Another embodiment will be described below. In the first embodiment, the time Tup is obtained by detecting the temperature of the second fixing device (output of the thermistor 23*d*) at the time when the second image forming job is inputted and calculating a time taken by the second fixing device to rise from the detected temperature to the set temperature at the time of image heating.

In this embodiment, however, a plurality of predetermined set times are set, the temperature of the second fixing device (output of the thermistor 23*d*) at the time when the second image forming job is inputted is detected, and one of the set times is selected in accordance with the detected temperature. For instance, the set temperature at the time of image heating is 200° C. and the following temperature ranges are prepared for the temperature of the second fixing device.

1) less than 30° C.
2) 30° C. or more and less than 70° C.
3) 70° C. or more and less than 120° C.
4) 120° C. or more In this case, when the detected temperature is in the temperature range 1), an image heatable state is started to be maintained 30 seconds before an expected time for starting the second image forming job. Also, when the detected temperature is in the temperature range 2), the image heatable state is started to be maintained 20 seconds before the expected time for starting the second image forming job. Further, when the detected temperature is in the temperature range 3), the image heatable state is started to be maintained 10 seconds before the expected time for starting the second image forming job. Still further, when the detected temperature is in the temperature range 4), the image heatable state is started to be maintained 5 seconds before the expected time for starting the second image forming job.

With this construction, when a new job that uses all of the image heating members is inputted during image formation that does not use some of image heating members, it becomes possible to elongate a standby state of each second image heating member, in which the second image heating member is set at a low temperature, without causing a delay of start of the new job using a simple construction in which a time taken by the second fixing device to rise from a temperature at the time when the new job is inputted to the set temperature is not calculated.

As described above, according to the present invention, when a new job that uses all of the image heating means is inputted during an image forming operation that does not use some of image heating means, it becomes possible to start the new job with a short wait time while reducing power consumption.

Embodiments of the present invention have been described above but the present invention is in no way limited to the embodiments of the present invention and various modifications are possible within the scope of the technical idea of the present invention.

This application claims priority from Japanese Patent Application No. 2005-112160 filed Apr. 8, 2005, which is hereby incorporated by reference herein.

What is claimed is:

1. An image forming apparatus, comprising:

a toner image forming device for forming a toner image on a recording material;

a fixing member for heat-fixing the toner image formed by the toner image forming device on the recording material;

a glossing member for enhancing glossiness of the toner image by heating the toner image heat-fixed on the recording material by the fixing member;

a performing device for performing a normal mode and a glossing mode wherein, in the normal mode the heat-fixed toner image is not heated by the glossing member, and in the glossing mode the heat-fixed toner image is heated by the glossing member;

a glossiness setting device for setting the glossiness of the toner image by setting a temperature of the glossing member in the glossing mode;

a temperature setting device for setting a temperature of the glossing member, wherein the temperature setting device sets the temperature of the glossing member in the normal mode to be lower than the temperature of the glossing member in the glossing mode, and wherein, when the image forming apparatus receives a command of a subsequent image forming job of the glossing mode while performing an image forming job of the normal mode, the temperature setting device raises the temperature of the glossing member before completing the image forming job of the normal mode; and a changing device for changing a time interval from receiving the command of the subsequent image forming job to starting to raise the temperature of the glossing member according to a time interval between receiving the command of the subsequent image forming job and completing the current image forming job of the normal mode, a temperature of the glossing member when receiving the command of the subsequent image forming job, and a glossiness of the toner image set by the glossiness setting device for the subsequent image forming job.

2. An image forming apparatus according to claim 1, wherein the changing device extends the time interval from receiving the command of the subsequent image forming job to starting to raise the temperature of the glossing member as a time interval from receiving the command of the subsequent image forming job to completing the current image forming job of the normal mode is increased.

3. An image forming apparatus according to claim 2, wherein the changing device extends the time interval from receiving the command of the subsequent image forming job to starting to raise the temperature of the glossing member as the temperature of the glossing member when receiving the command of the subsequent image forming job is increased.

4. An image forming apparatus according to claim 3, wherein the changing device extends the time interval from receiving the command of the subsequent image forming job to starting to raise the temperature of the glossing member as the glossiness of the glossing member set by the glossiness setting device for the subsequent image forming job is decreased.

5. An image forming apparatus according to claim 4, wherein the changing device changes the time interval from receiving the command of the subsequent image forming job to starting to raise the temperature of the glossing member so that the temperature of the glossing member reaches a set temperature of the glossing member set by the temperature setting device for the subsequent image forming job at a time when the image forming job of the normal mode is completed.

* * * * *